United States Patent [19]

Schoenung

[11] 4,223,488

[45] Sep. 23, 1980

[54] CEILING HANGER

[75] Inventor: Alois F. Schoenung, Naperville, Ill.

[73] Assignee: Rapid Mounting & Finishing Company, Chicago, Ill.

[21] Appl. No.: 34,847

[22] Filed: Apr. 30, 1979

[51] Int. Cl.[3] ..... G09F 7/18

[52] U.S. Cl. ..... 52/39; 248/22; 248/228; 248/343

[58] Field of Search ..... 52/38, 39; 248/228, 248/72, 489, 340, 226.1, 343, 317, 320, 339

[56] References Cited

U.S. PATENT DOCUMENTS

| | | | |
|---|---|---|---|
| 1,983,670 | 12/1934 | Knight | 248/228 |
| 3,029,055 | 4/1962 | Smith | 248/228 |
| 3,053,494 | 9/1962 | Stoll | 248/228 |
| 3,140,848 | 7/1964 | Sherburne | 248/228 X |
| 3,217,833 | 11/1965 | Smith | 248/228 X |
| 3,561,718 | 2/1971 | Iverson | 248/489 X |
| 3,618,176 | 11/1971 | Barnes | 248/343 X |
| 3,743,228 | 7/1973 | Drab | 248/228 |
| 3,936,913 | 2/1976 | Weissman | 248/317 X |
| 4,112,550 | 9/1978 | DeWitt et al. | 248/228 X |

*Primary Examiner*—Carl D. Friedman

*Attorney, Agent, or Firm*—Wegner, Stellman, McCord, Wiles & Wood

[57] ABSTRACT

A ceiling hanger adapted to be removably installed on a horizontal supporting strip of a tile ceiling structure wherein tile panels are provided with edge portions resting on opposed edge portions of the supporting strip. The hanger includes a plate having a U-shaped end portion embracing one edge of the supporting strip, a midportion underlying the supporting strip, and a retaining clip embracing the opposite edge of the supporting strip and retaining the plate midportion juxtaposed to the underside of the supporting strip. The plate further includes a distal hanger portion which is bent downwardly about a connecting portion of the plate to provide a support such as for hanging an advertisement or the like from the ceiling supporting strip.

15 Claims, 5 Drawing Figures

FIG. 1
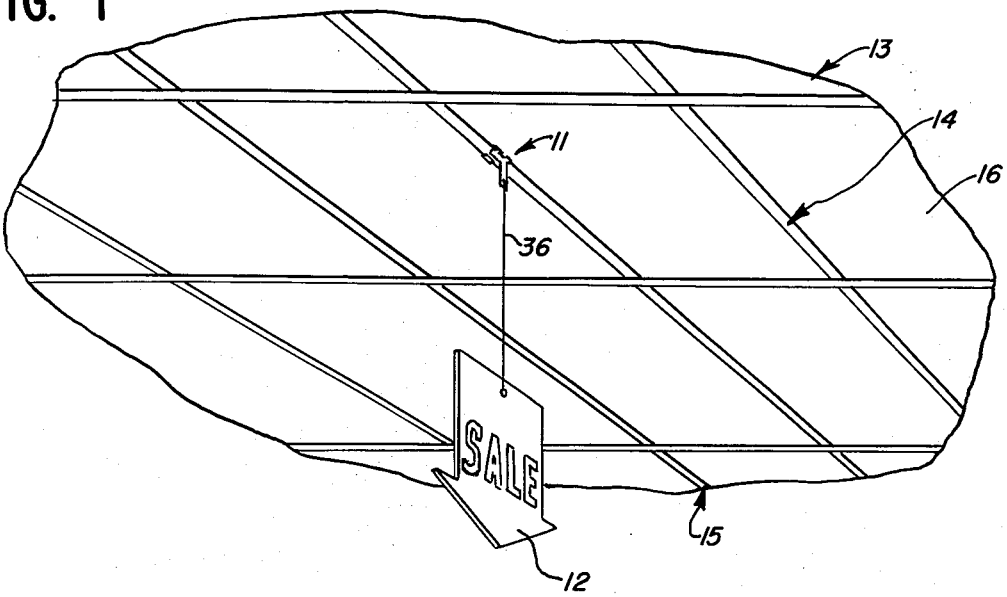
FIG. 2
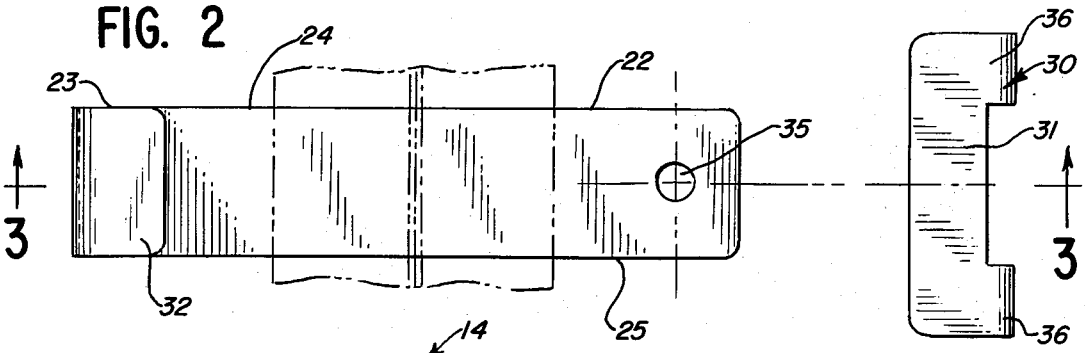
FIG. 3
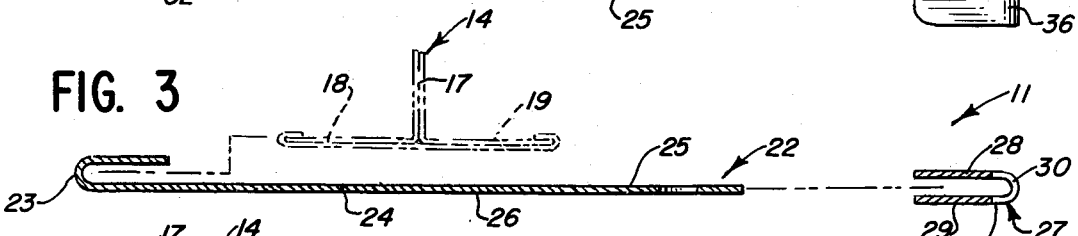
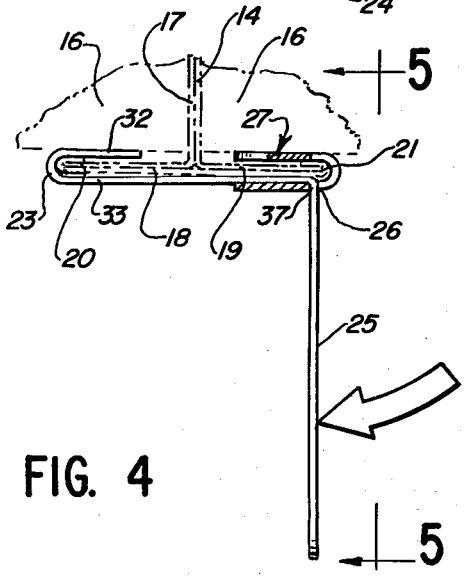
FIG. 4
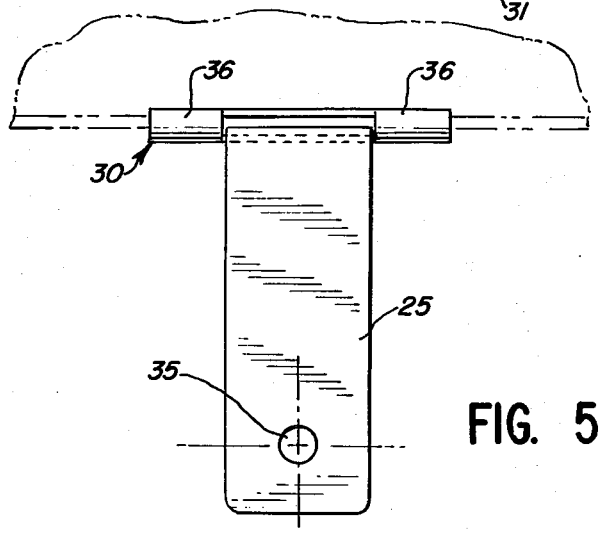
FIG. 5

CEILING HANGER

BACKGROUND OF THE INVENTION

1. Field of the Invention

This invention relates to support devices and in particular to a support device hanging an element from a horizontally extending supporting strip of a panel-type ceiling.

2. Description of the Prior Art

In one conventional form of drop ceiling, a grid of horizontally extending support strips is provided. Ceiling tile panels or the like are removably supported on the opposed edges of the support strips so as to form a ceiling structure wherein the support strips are exposed downwardly of the juxtaposed edges of the adjacent ceiling tile panels.

In one conventional form, the supporting strip has a T-section and is provided with means for hanging thereof from a superjacent building ceiling wall structure.

One conventional use of such ceiling structures is in retail sales establishments, such as grocery stores and the like. It is desirable to provide means for hanging from the ceiling advertisements, such as placards, promotional devices, etc. A number of different devices have been developed over the years for securing such elements to the ceiling structure. The present invention is concerned with an improved form of such supporting means.

SUMMARY OF THE INVENTION

The present invention more specifically comprehends an improved hanger for use with a ceiling structure having a pair of ceiling panels provided with opposed edge portions carried on a horizontally supporting strip of the ceiling structure. The hanger includes a plate having a U-shaped end portion adapted to embrace one edge of the supporting strip, a midportion adapted to underlie the supporting strip with the turned end is disposed to embrace the one edge thereof, a distal hanger portion, and a bendable connecting portion connecting the hanger porion to the midportion, and a U-shaped retaining clip having a pair of spaced sidewalls and a bight portion connecting the sidewalls at one edge thereof, the bight portion being provided with a slot for extension of the plate hanger portion therethrough, the clip being adapted to embrace the edge of the supporting strip opposite the one edge to secure the midportion across the underside of the strip, the connecting portion being turned to cause the hanger portion to extend downwardly from the secured midportion and prevent movement of the clip away from its edge-embracing relationship with the supporting strip.

The connecting portion may be permanently deflectible and, in the illustrated embodiment, the plate is formed of bendable material, such as sheet metal.

The retaining clip may similarly be formed of sheet metal.

The hanger is adapted for adjustable mounting to the supporting strip of the ceiling structure by virtue of permitting the bending of the connecting portion suitably to cause the retaining clip to firmly embrace the edge of the supporting strip in connecting the hanger plate to the supporting strip.

The distal hanger portion of the plate may be provided with an opening for permitting tying of a flexible element to the hanger portion where desired .

In the illustrated embodiment, each of the U-shaped end portion of the plate and the retaining clip define spaced leg portions which are accurately positioned to provide improved embracing of the supporting strip edge portions.

In the illustrated embodiment, the U-shaped end of the plate has a spacing between the leg portions thereof substantially equal to the thickness of the supporting strip edge portion. The retaining clip may have a spacing between the leg portions thereof equal to the thickness of the retaining strip edge portion plus the thickness of the plate.

The hanger of the present invention is extremely simple and economical of construction while yet providing an improved hanger means for use in a ceiling structure as discussed above.

BRIEF DESCRIPTION OF THE DRAWING

Other features and advantages of the invention will be apparent from the following description taken in connecton with the accompanying drawing wherein:

FIG. 1 is a perspective view of a ceiling structure provided with a hanger embodying the invention for carrying from the ceiling structure an advertising element;

FIG. 2 is an enlarged plan view illustrating a first step in the mounting of the hanger to the ceiling structure supporting strip;

FIG. 3 is a side elevation thereof;

FIG. 4 is a side elevation illustrating the arrangement of the hanger upon mounting thereof to the ceiling structure supporting strip; and FIG. 5 is a front elevation thereof looking in the direction of the arrows of FIG. 4.

DESCRIPTION OF THE PREFERRED EMBODIMENT

In the exemplary embodiment of the invention as disclosed in the drawing, an improved hanger generally designated 11 is shown for use in supporting an element, such as an advertising placard 12, from a ceiling structure generally designated 13. The ceiling structure may comprise a drop-type ceiling formed of a plurality of supporting strips 14 forming a grid arrangement generally disignated 15 wherein a plurality of ceiling tile panels 16 are supported along their edges by cooperating ones of the grid strips 14.

In the illustrated embodiment, and as best seen in FIG. 4, the supporting strip 14 may comprise a conventional supporting strip having a "T" cross section including an upright portion 17 and a pair of laterally projecting base portions 18 and 19. The base portions, in turn, define outer edge portions 20 and 21, respectively.

Hanger 11 includes a plate 22 having a U-shaped turned end 23, a midportion 24, and a distal hanger portion 25. Hanger portion 25 is connected to the midportion 24 by a connecting portion 26 which is bendable so as to dispose the hanger portion selectively in the plane of the midportion 24, as seen in FIG. 3, or extending downwardly at right angles therefrom, as seen in FIG. 4. As shown, the connecting portion 26 is spaced from the end of plate 22 defined by the U-shaped portion 23 a distance approximately equal to the widths of the supporting strip portions 18 and 19.

Hanger 11 further includes a retaining clip 27, which, as seen in FIG. 3, comprises a U-section element having leg portions 28 and 29 connected by a bight portion 30. As seen in FIG. 2, the bight portion 30 is provided with a slot 31 adapted to have free extension therethrough of the plate portions 25 and 26.

The spacing between legs 28 and 29 of the retaining clip may be approximately equal to the thickness of the plate 22 and the supporting strip lateral portion so that in the secured arrangement of FIG. 4, the retaining clip embraces the edge portion of the supporting strip, such as edge portion 21 illustrated in FIG. 4. As further shown in FIG. 4, the turned end 23 similarly embraces the opposite edge portion of the supporting strip. As seen in the drawing, the legs 32 and 33 of the turned end portion 23 are spaced apart substantially only the thickness of the strip edge portion so as to provide similar embracing engagement with the strip edge portion.

As further shown in FIG. 4, upon securing of the plate 22 to the strip portions 18 and 19 by the embracing engagement of the end portion 23 and retaining clip 27 therewith, the hanger portion 25 is swung downwardly about connecting portion 26, thereby locking the retaining clip in embracing relationship with the supporting strip edge portion 21 and further arranging the hanger portion 25 for connection thereto of an element to be supported by the hanger 11.

As shown in FIGS. 2 and 5, the hanger portion 25 may be provided with a suitable hole 35 such as for permitting an extensible element, such as cord 36, to be tied to the hanger portion through the hole, as illustrated in FIG. 1. Thus, the cord 36 may be used to support the advertising placard 12 from the ceiling structure supporting strip in a simple and efficient manner.

It has been found that the retaining clip 27 is effectively positively locked in embracing relationship with the supporting strip by the downturning of the hanger portion 25, as shown in FIG. 4. Thus, a positive, fixed connection of the hanger to the supporting strip is readily effected. However, if it is desired to remove the hanger or to move it on the supporting strip, the user need merely bend the hanger portion 25 reversely about the connecting portion 26 back to the planar arrangement of FIG. 3, thereby permitting the withdrawal of the retaining clip from embracing relationship with the supporting strip edge portion as desired.

In the illustrated embodiment, the plate 22 is formed of a bendable sheet metal, such as aluminum, having a sufficient thickness so as to permit the facilitated bending of portions thereof while yet effectively firmly retaining the bent portions in the bent arrangement as desired. In the illustrated embodiment, the retaining clip is similarly formed of a sheet of metal, such as aluminum. Thus, the hanger 11 is of extremely low cost construction while yet providing the highly improved support functioning as discussed above.

The turned wall portions 30 of the retaining clip at the opposite ends of the slot 31 provide a strong support of the edge 37 of clip leg 29 defining the lower edge of the slot whereby the connecting portion 26 is firmly supported during the bending thereof in turning plate end 25 downwardly to the arrangement of FIG. 4.

The foregoing disclosure of specific embodiments is illustrative of the broad inventive concepts comprehended by the invention.

I claim:

1. For use with a ceiling structure having a pair of flat ceiling panels having opposed edge portions carried on a horizontal supporting strip, an improved hanger comprising:

a plate having a U-shaped end portion adapted to embrace one edge of the supporting strip, a midportion adapted to underlie the supporting strip when the turned end is disposed to embrace the one edge thereof, a distal hanger porton, and a bendable connecting portion connecting the hanger portion to said midportion; and a U-shaped retaining clip having a pair of spaced sidewalls and a bight portion connecting the sidewalls at one edge thereof, said bight portion being provided with a slot for extension of said plate hanger portion therethrough, said clip being adapted to embrace the edge of the supporting strip opposite said one edge to secure said midportion across the underside of the strip, said connecting portion being turned to cause said hanger portion to extend downwardly from said secured midportion and prevent movement of said clip away from its edge-embracing relationship with the supporting strip.

2. The hanger of claim 1 wherein said plate is formed of bendable sheet metal.

3. The hanger of claim 1 wherein said hanger portion is provided with an opening for supporting a tie element.

4. The hanger of claim 1 wherein said retaining clip is formed of sheet metal.

5. The hanger of claim 1 wherein said slot is substantially larger than said plate cross section to permit free movement of the clip in the plate prior to mounting of the hanger to the ceiling structure supporting strip.

6. The hanger of claim 1 wherein at least one edge of said slot extends into the sidewall portion of the clip.

7. The hanger of claim 1 wherein at least one edge of said slot extends into the sidewall portion of the clip a distance substantially equal to the thickness of said plate.

8. The hanger of claim 1 wherein said end portion of the plate comprises an integrally formed turned end portion thereof.

9. The hanger of claim 1 wherein said bight portion of the clip spaces the sidewalls apart a distance substantially equal to the cumulative thickness of said plate and the ceiling structure supporting strip.

10. The hanger of claim 1 wherein said bight portion of the clip spaces the sidewalls apart a distance substantially equal to the cumulative thickness of said plate and the ceiling structure supporting strip and said U-shaped end portion of the plate defines sidewalls spaced apart a distance substantially equal to the thickness of the ceiling structure mounting strip alone.

11. In a tile ceiling structure having a pair of tile members having opposed edge portions carried on a horizontal supporting strip defining opposed side edge portions, the improvement comprising:

a support plate having a U-shaped end portion adapted to embrace one of said side edge portions of the supporting strip, a midportion underlying the supporting strip, a distal hanger portion, and a bent connecting portion connecting the hanger portion to said midportion; and a U-shaped retaining clip having a pair of spaced sidewalls and a bight portion connecting the sidewalls at one edge thereof, said bight portion being provided with a slot for extension of said plate therethrough, said clip embracing the edge portion of the supporting strip opposite said one edge portion to secure said midportion across the underside of the strip, said downwardly turned hanger portion defining means for preventing movement of said clip away from its embracing relationship with said opposite edge portion of the supporting strip.

12. The ceiling structure of claim 11 wherein said connecting portion comprises a continuous portion of said plate which may be turned subsequent to the embracing of said opposite side edge portion by said clip to provide opposed embracing of said side edge portion by said plate U-shaped end and said clip in adjusted spaced relationship.

13. The ceiling structure of claim 11 wherein said U-shaped end portion of the plate resiliently grips said supporting strip edge portion.

14. The ceiling structure of claim 11 wherein said retaining clip resiliently grips the facially juxtaposed supporting strip opposite edge portion and plate midportion.

15. The ceiling structure of claim 11 wherein said supporting strip defines a T-section for undeformably permitting support of a substantial weight on said hanger portion of the support plate.

* * * * *